US008403464B2

(12) United States Patent
Kanaya

(10) Patent No.: US 8,403,464 B2
(45) Date of Patent: Mar. 26, 2013

(54) LIQUID EJECTING HEAD AND MANUFACTURING METHOD THEREOF, AND LIQUID EJECTING APPARATUS

(75) Inventor: Munehide Kanaya, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 363 days.

(21) Appl. No.: 12/705,496

(22) Filed: Feb. 12, 2010

(65) Prior Publication Data

US 2010/0208009 A1 Aug. 19, 2010

(30) Foreign Application Priority Data

Feb. 16, 2009 (JP) ..... 2009-032360

(51) Int. Cl.
*B41J 2/175* (2006.01)

(52) U.S. Cl. ..... 347/85; 347/93

(58) Field of Classification Search ..... 347/84, 347/85, 86, 93
See application file for complete search history.

(56) References Cited

U.S. PATENT DOCUMENTS

| | | | | |
|---|---|---|---|---|
| 5,556,541 | A | 9/1996 | Ruschke | |
| 6,634,742 | B2 | 10/2003 | Owaki et al. | |
| 7,399,061 | B2 * | 7/2008 | Owaki et al. | 347/50 |
| 7,461,909 | B2 * | 12/2008 | Zhang et al. | 347/86 |
| 2009/0122125 | A1 | 5/2009 | Owaki et al. | |

FOREIGN PATENT DOCUMENTS

| | | | |
|---|---|---|---|
| JP | 06-079110 | A | 3/1994 |
| JP | 07-289858 | A | 11/1995 |
| JP | 2001-082390 | A | 3/2001 |
| JP | 2002-178541 | A | 6/2002 |
| JP | 2008-213253 | A | 9/2008 |
| JP | 2009-132135 | A | 6/2009 |

* cited by examiner

*Primary Examiner* — Jannelle M Lebron
(74) *Attorney, Agent, or Firm* — Kilpatrick Townsend & Stockton LLP

(57) ABSTRACT

A liquid ejecting head includes a first flow channel member that configures part of the wall surface of a liquid flow channel, a second flow channel member that configures a different part of the wall surface of the liquid flow channel than the part configured by the first flow channel member, and an integral molded member, formed around the liquid flow channel, that joins the first flow channel member with the second flow channel member through integral molding. An elastic member that is sandwiched between the first flow channel member and the second flow channel member and is more elastically deformable than the first flow channel member and the second flow channel member, is provided around the liquid flow channel, and the integral molded member is formed on the outside of the elastic member sandwiched between the first flow channel member and the second flow channel member.

10 Claims, 6 Drawing Sheets

LIQUID EJECTING HEAD AND MANUFACTURING METHOD THEREOF, AND LIQUID EJECTING APPARATUS

This application claims priority to Japanese Patent Application No. 2009-032360, filed Feb. 16, 2009, the entirety of which is incorporated by reference herein.

BACKGROUND

1. Technical Field

The present invention relates to a liquid ejecting head that ejects a liquid, a manufacturing method thereof, and a liquid ejecting apparatus, and particularly relates to an ink jet recording head that discharges ink, a manufacturing method thereof, and an ink jet recording apparatus.

2. Related Art

In an ink jet recording head, which is a representative example of a liquid ejecting head, ink is generally supplied to the head body from a reservoir unit filled with ink, such as an ink cartridge, and the ink supplied to the head body is then discharged from a nozzle by driving a pressure generating unit such as a piezoelectric element, a heating element.

Some such ink jet-type recording heads include a flow channel member configured of two jointed members each other, in which a liquid flow channel that creates an opening in a joint surface is provided, thus making the two members communicable via the liquid flow channel (for example, see JP-A-2002-178541).

However, when the two members of which the flow channel member including the liquid flow channel is configured are joined using an adhesive, an adhesive having a low gas transmissibility generally has a low bond strength, which can result in a problem in that bonding failures between the two members occur and the liquid leaks in the bonded region. Conversely, an adhesive having a high bond strength also has a high gas transmissibility, which can result in a problem in that gas contained in the liquid within the liquid flow channel leaks to the exterior, and gas from the exterior permeates into the flow channel.

Meanwhile, although a method whereby the two members of which the flow channel member is configured are joined through welding such as heat welding, ultrasonic welding may be considered, such welding can similarly result in a problem in that liquid leaks from the region at which the two members configuring the flow channel member are joined. While using an easily-weldable material resistant to liquid leaks as the two members of which the flow channel member is configured can be considered, this has a problem in that easily-weldable materials have poor gas barrier properties, and thus gas in the liquid within the liquid flow channel leaks to the exterior, and gas from the exterior permeates into the flow channel.

It should be noted that such problems are not limited to ink jet recording heads, and are also present in other liquid ejecting heads that eject liquid, aside from ink jet recording heads.

SUMMARY

An advantage of some aspects of the invention is a liquid ejecting head, manufacturing method thereof, and liquid ejecting apparatus capable of suppressing liquid leaks while improving gas barrier properties and therefore improving reliability.

To solve the aforementioned problems, an aspect of the invention is a liquid ejecting head including a first flow channel member that configures part of the wall surface of a liquid flow channel, a second flow channel member that configures a different part of the wall surface of the liquid flow channel than the part configured by the first flow channel member, and an integral molded member, formed around the liquid flow channel, that joins the first flow channel member with the second flow channel member through integral molding. An elastic member that is more elastically deformable than the first flow channel member and the second flow channel member is provided around the liquid flow channel so as to be sandwiched between the first flow channel member and the second flow channel member, and the integral molded member is formed on the outside of the elastic member and sandwiched between the first flow channel member and the second flow channel member.

According to this aspect, part of the integral molded member can be suppressed from entering the liquid flow channel by the elastic member. In addition, joining the first flow channel member with the second flow channel member by molding the integral molded member makes it possible to suppress liquid from leaking from the seams between the first flow channel member and the second flow channel member. Furthermore, joining the first flow channel member with the second flow channel member by molding the integral molded member makes it possible to use a material that has high gas barrier properties and is resistant to liquid leaks as the material for the first flow channel member, the second flow channel member, and integral molded member.

Here, it is preferable for the elastic member not to protrude into the liquid flow channel. This makes it possible to prevent part of the elastic member from becoming a foreign object within the liquid flow channel and partially obstructing the flow channel, prevent bubbles from accumulating at corners defined by the elastic member and the liquid flow channel, and so on.

In addition, it is preferable for the elastic member to be formed by weaving filaments together. This makes it possible to obtain desired elasticity properties and the desired permeation strength with respect to the melted resin to be used as the integral molded member.

In addition, it is preferable for the elastic member to be a plate-shaped member in which multiple pores are formed, and a non-planarity may be formed in at least one side of the plate-shaped member. This makes it possible to obtain desired elasticity properties and the desired permeation strength with respect to the melted resin to be used as the integral molded member.

Furthermore, another aspect of the invention is a liquid ejecting apparatus including the liquid ejecting head according to the aforementioned aspects.

According to this aspect, it is possible to realize a more highly-reliable liquid ejecting apparatus by reducing liquid leaks and improving the gas barrier properties.

In addition, another aspect of the invention is a manufacturing method for a liquid ejecting head that includes a first flow channel member that configures part of the wall surface of a liquid flow channel, a second flow channel member that configures a different part of the wall surface of the liquid flow channel than the part configured by the first flow channel member, and an integral molded member, formed around the liquid flow channel, that joins the first flow channel member with the second flow channel member through integral molding. The manufacturing method includes, in a state in which an elastic member that is more elastically deformable than the first flow channel member and the second flow channel member is sandwiched between the first flow channel member and the second flow channel member so as to surround the liquid flow channel, forming, through integral molding, an integral molded member on the outside of the elastic member and sandwiched between the first flow channel member and the second flow channel member, thereby joining the first flow channel member with the second flow channel member.

According to this aspect, melted material can be suppressed from entering the liquid flow channel by the elastic member when molding the integral molded member. Furthermore, this makes it possible to use a material that has high gas barrier properties and is resistant to liquid leaks as the material for the first flow channel member, the second flow channel member, and integral molded member.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will be described in detail hereinafter based on embodiments.

First Embodiment

Figure 1:
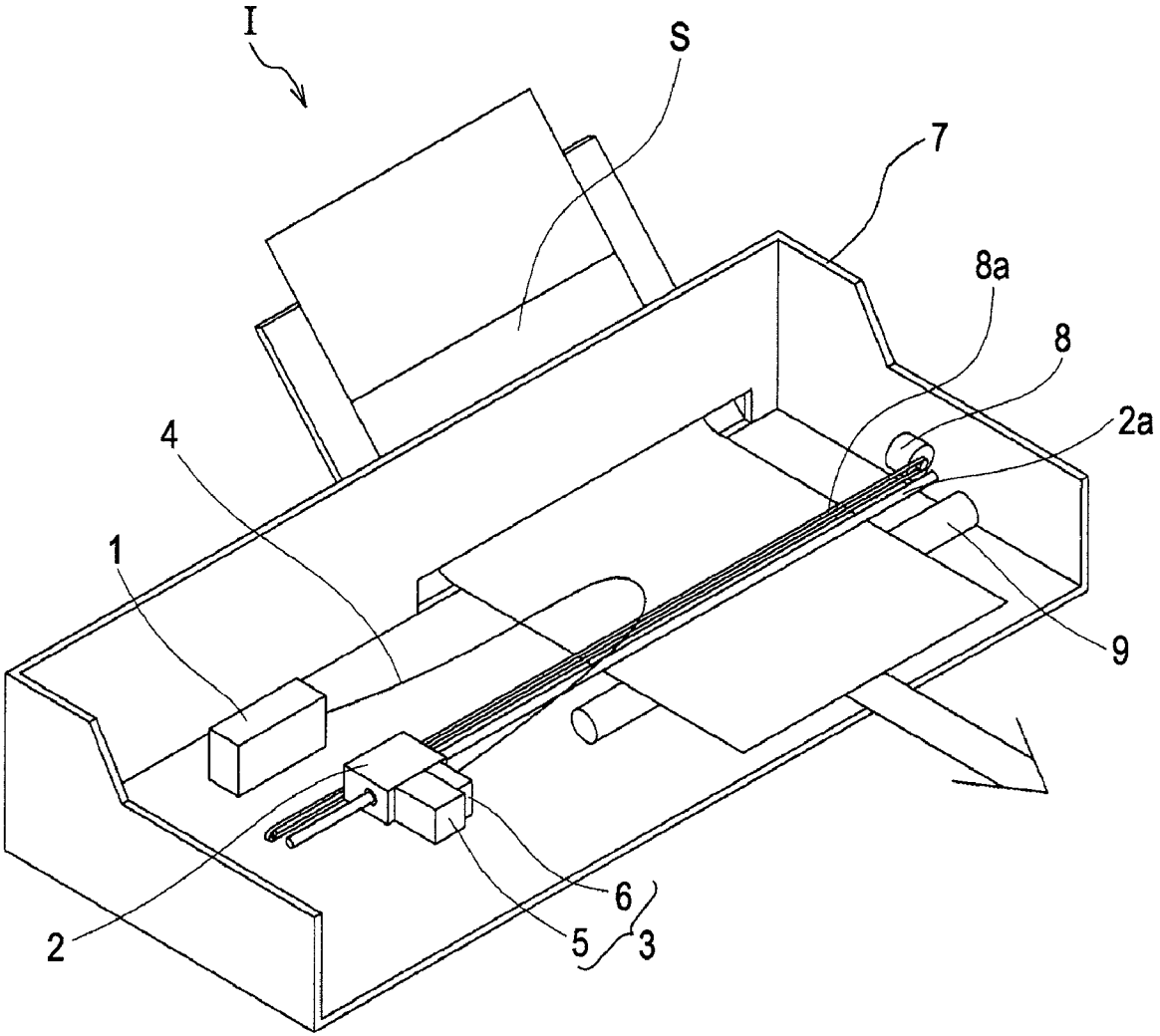
FIG. 1 is an overall perspective view of a recording apparatus according to a first embodiment of the invention.

FIG. 1 is an overall perspective view of an ink jet recording apparatus serving as an example of a liquid ejecting head according to a first embodiment of the invention. As shown in FIG. 1, in this embodiment, ink from a reservoir unit 1 that holds ink is supplied, via a supply line 4, to an ink jet recording head 3 mounted in a carriage 2. The ink jet recording head 3 includes a head body 5 in which is provided a nozzle opening that discharges ink and a flow channel member 6 to which is connected a supply line 4 that supplies ink from the reservoir unit 1 to the head body 5.

The carriage 2 in which the ink jet recording head 3 is mounted is disposed so as to be mobile in the axial direction of a carriage shaft 2*a* provided within an apparatus housing 7.

The carriage 2 in which is mounted the ink jet recording head 3 is moved along the carriage shaft 2*a* by a driving motor 8 transmitting driving power to the carriage 2 via multiple gears (not shown) and a timing belt 8*a*. Meanwhile, a platen 9 is disposed in the apparatus housing 7 along the same direction as the carriage shaft 2*a*, and a recording sheet S, which is a recording medium such as paper supplied by paper supply rollers and the like (not shown), is entrained and transported by the platen 9.

In such an ink jet recording apparatus I, the carriage 2 moves along the carriage shaft 2*a* while ink is discharged by the head body 5 of the ink jet recording head 3, thereby printing onto the recording sheet S.

Figure 2:
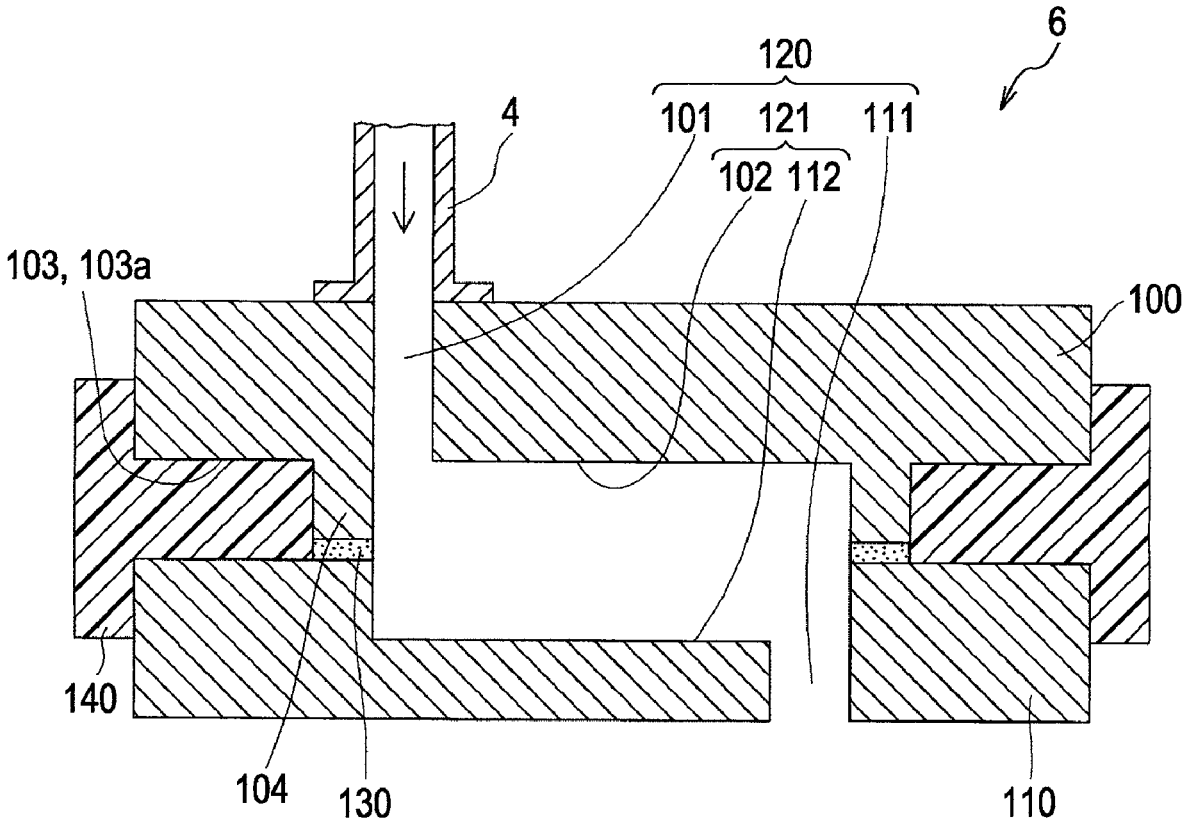
FIG. 2 is a cross-section of a flow channel member according to the first embodiment of the invention.

Here, the flow channel member 6, of which part of the ink jet recording head 3 is configured, will be described with reference to FIG. 2. Note that FIG. 2 is a cross-section of the flow channel member. As shown in FIG. 2, the flow channel member 6 includes a first flow channel member 100 to which one end of the supply line 4 is connected, the other end of the supply line 4 being connected to the reservoir unit 1; and a second flow channel member 110, which is joined to the first flow channel member 100 and connected to the head body 5.

A liquid flow channel 120, for supplying ink from the reservoir unit 1 (supply line 4) to the head body 5, is provided in the first flow channel member 100 and the second flow channel member 110.

The first flow channel member 100 is configured of a metal, a resin, or the like. In addition, the first flow channel member 100 is provided with an input channel 101, passing through the member in the thickness direction, to which one end of the supply line 4 is connected; and a first communication channel 102, opening on the side opposite to the input channel 101 where the supply line 4 is connected, and having a concave shape in which one end communicates with the input channel 101.

The second flow channel member 110 is configured of a metal, a resin, or the like, and is joined through integral molding to the surface of the first flow channel member 100 on which the first communication channel 102 opens, which will be described in detail later.

The second flow channel member 110 is provided with a second communication channel 112 having a concave form that opens on the side joined to the first flow channel member 100. The first flow channel member 100 and the second flow channel member 110 are joined to each other through integral molding so that the first communication channel 102 and the second communication channel 112 communicate with each other. A communication channel 121 is thus formed by the first communication channel 102 and the second communication channel 112. In other words, the first communication channel 102 of the first flow channel member 100 defines one wall surface of the communication channel 121 serving as part of the liquid flow channel 120, and the second communication channel 112 of the second flow channel member 110 defines the other wall surface of the communication channel 121 serving as part of the liquid flow channel 120.

Furthermore, the second flow channel member 110 is provided with an output channel 111, passing through the member in the thickness direction, that communicates with the end of the communication channel 121 on the side opposite to the end that communicates with the input channel 101. The other end of the output channel 111, on the side opposite to the end that communicates with the communication channel 121, is connected to the head body 5 (not shown).

In this embodiment, the liquid flow channel 120 that supplies ink from the reservoir unit 1 to the head body 5 is configured of the input channel 101, communication channel 121, and output channel 111 provided in the first flow channel member 100 and the second flow channel member 110. In other words, the ink supplied from the reservoir unit 1 via the supply line 4 is supplied to the head body 5 via the input channel 101, the communication channel 121, and output channel 111.

Meanwhile, an indented portion 103 is provided in the first flow channel member 100 across the outer circumference of the first communication channel 102, and a protruding portion 104, protruding toward the second flow channel member 110, is provided between the first communication channel 102 and the indented portion 103. An elastic member 130 that is more elastically deformable than the first flow channel member 100 and the second flow channel member 110 is provided between the protruding portion 104 and the second flow channel member 110, or in other words, between the first flow channel member 100 and the second flow channel member 110, so as to surround the liquid flow channel (the communication channel 121 in this embodiment).

When the elastic member 130 is strongly sandwiched between the protruding portion 104 and the second flow channel member 110, the elastic member 130 deforms, closing the gap between the protruding portion 104 and the second flow channel member 110.

This elastic member 130 has a circular form that follows the outer circumference of the communication channel 121. A resin such as polyethylene, a metal such as stainless steel, or the like may be used as the material for this elastic member 130. When using a metal, a member provided with, for example, multiple micropores created by finely weaving together metal filaments, usable as an ink filter, can be used as the elastic member 130. Other examples of members usable as the elastic member 130 include a plate made of metal or the like provided with multiple micropores passing through the plate, usable as an ink filter; a member provided with non-planarity capable of being pressed against the surface of the plate; a member in which the plate is curved in a non-planar form; and so on. Incidentally, filters in which metal filaments or the like have been finely woven together, plate-form filters, and so on are more elastically deformable in the thickness direction than the first flow channel member 100 and the second flow channel member 110 configured of resin, a metal, or the like. In other words, the elastic member 130 being more elastically deformable than the first flow channel member 100 and the second flow channel member 110 refers not only to the components (materials) themselves being more elastically deformable, but also includes components (materials) that are themselves less elastically deformable than the first flow channel member 100 and the second flow channel member 110 but which have been made more elastically deformable through their constructions. To rephrase, the elastic member 130 may be a material (component) that is less elastically deformable than the flow channel member 6 when in the same form as the first flow channel member 100 and the second flow channel member 110, of which the flow channel member 6 is configured.

Of course, the elastic member 130 is not limited to the aforementioned materials. In this embodiment, a single flat filter, created by forming micropores by finely weaving metal filaments together and cutting the filter into a predetermined shape, is used as the elastic member 130.

In addition, the elastic member 130 is provided so as to be sandwiched between the first flow channel member 100 and the second flow channel member 110 without protruding into the liquid flow channel 120 (communication channel 121). In other words, the elastic member 130 is provided only around the perimeter of the liquid flow channel 120 (communication channel 121), and is not provided within the liquid flow channel 120 (communication channel 121). If the elastic member 130 protrudes into the liquid flow channel 120, there is the risk that bubbles within the ink will accumulate at corners or the like defined by the elastic member 130 and the liquid flow channel 120. However, ensuring that the elastic member 130 does not protrude into the liquid flow channel 120 makes it possible to prevent with certainty the accumulation of bubbles caused by the elastic member 130 within the liquid flow channel 120.

In addition, the indented portion 103 of the first flow channel member 100 forms a groove portion 103*a* which is open on the side surface of flow channel member 6, by defining one side surface of the second flow channel member 110. An integral molded member 140 is provided within the groove portion 103*a*. The first flow channel member 100 and the second flow channel member 110 are joined together (through integral molding) by forming the integral molded member 140 through molding within the groove portion 103*a* provided between the first flow channel member 100 and the second flow channel member 110. In other words, the integral molded member 140 is formed as a mold of the groove portion 103*a* provided between the first flow channel member 100 and the second flow channel member 110. Joining through integral molding refers to joining the first flow channel member 100 and the second flow channel member 110 together by molding the integral molded member 140 so as to make contact with both the first flow channel member 100 and the second flow channel member 110.

This integral molded member 140 is provided within the groove portion 103*a*, or in other words, in the circumferential direction on the outer side of the elastic member 130. Note that the integral molded member 140 may be formed between the elastic member 130 and the first and second flow channel members 100 and 110. In other words, if the elastic member 130 is made of a material used as a filter as described above, there are cases where regions in which less force is exerted arise in the end areas of the elastic member 130, and because gaps between the elastic member 130 and the first and second flow channel members 100 and 110 arise in these regions as a result, the integral molded member 140 may partially enter these gaps. Although it is conceivable to form part of the integral molded member 140 between the elastic member 130 and the first and second flow channel members 100 and 110, in actuality, the gaps are pressed shut in areas where a large force is exerted on the elastic member 130, and thus the resin used as the integral molded member 140 will not escape into the liquid flow channel 120.

Furthermore, when the first flow channel member 100 and the second flow channel member 110 are joined through integral molding by the integral molded member 140 in this manner, the elastic member 130 is sandwiched between the first flow channel member 100 and the second flow channel member 110 around the perimeter of the liquid flow channel 120; this prevents the liquid within the liquid flow channel 120 (communication channel 121) from escaping to the exterior from between the first flow channel member 100 and the second flow channel member 110, even if the force exerted on the elastic member 130 weakens. Here, a method for manufacturing this flow channel member 6 will be described in detail. Note that FIGS. 3A and 3B are cross-sections illustrating a method for manufacturing the flow channel member.

Figure 3A:
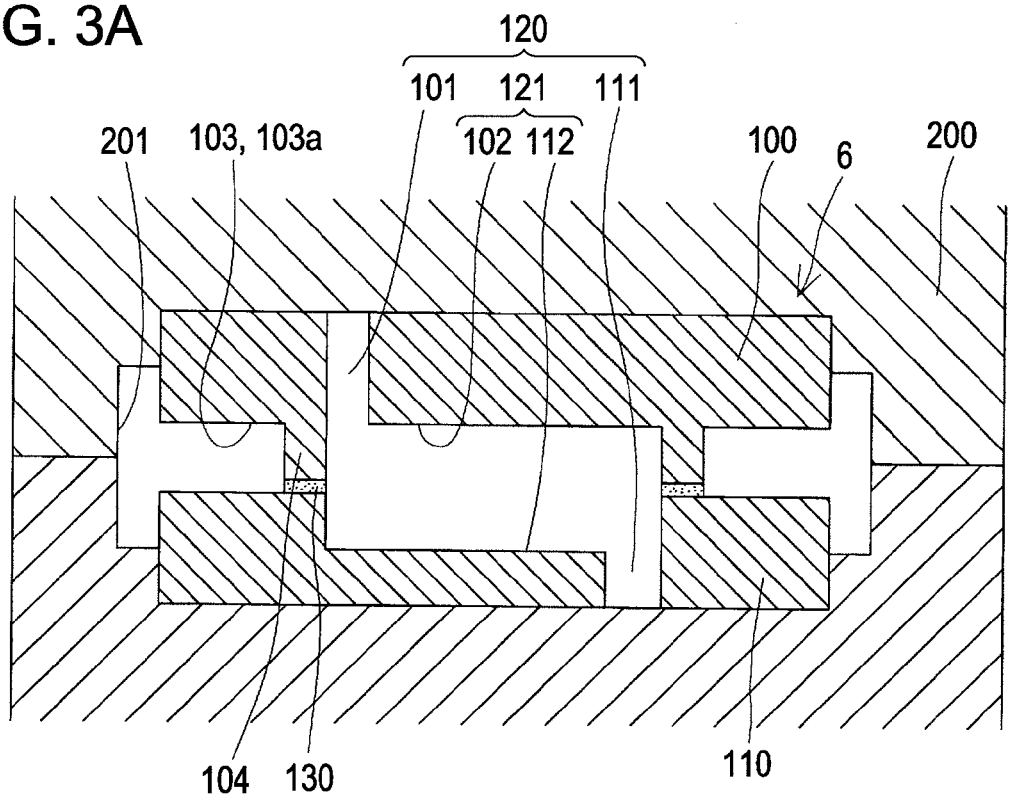
FIGS. 3A and 3B are cross-sections illustrating a manufacturing method for a recording head according to the first embodiment of the invention.

First, as shown in FIG. 3A, a metallic mold 200 is fitted together with the elastic member 130 being sandwiched between the first flow channel member 100 and the second flow channel member 110. The metallic mold 200 is split into upper and lower members, and contains a cavity 201 in which the integral molded member 140 is formed.

Figure 3B:
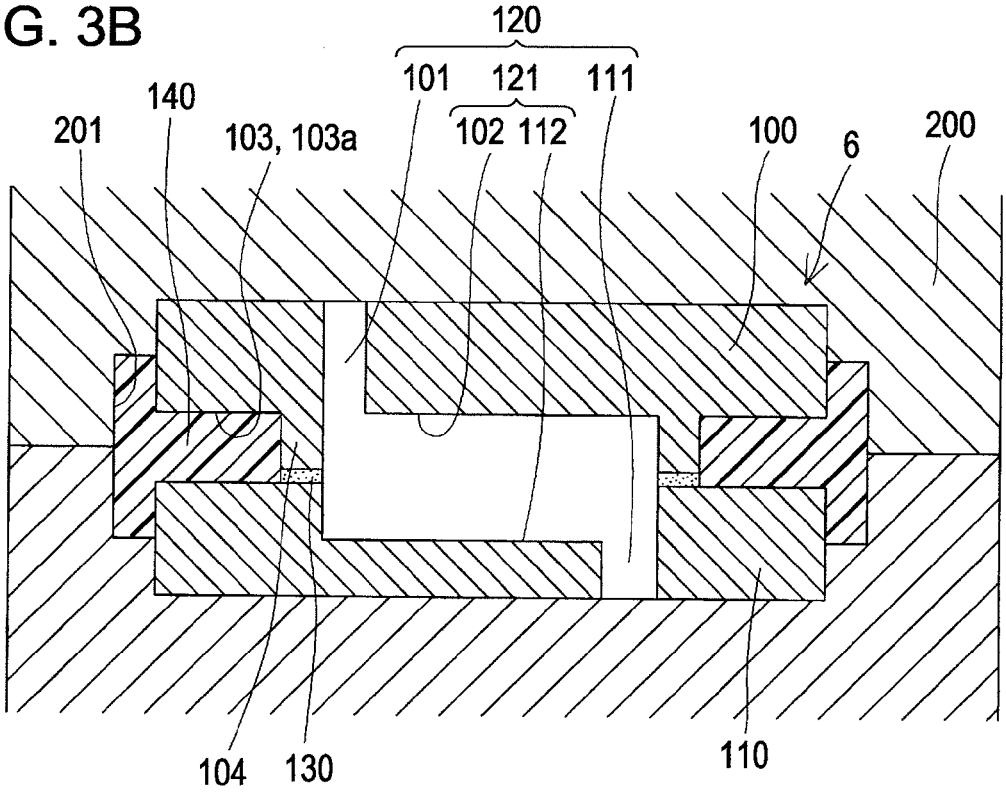

The flow channel member 6 is then formed by integrally molding the integral molded member 140, as shown in FIG. 3B. To be more specific, a melted resin is injected into the cavity 201 and the groove portion 103*a* via a gate (not shown) in the metallic mold 200, thereby forming the integral molded member 140. At this time, the elastic member 130 is disposed around the perimeter of the liquid flow channel 120 (communication channel 121) provided in the first flow channel member 100 and the second flow channel member 110, thus preventing the melted resin from flowing into the liquid flow channel 120. In other words, even if the melted resin within the cavity 201 is injected into the micropores provided within the elastic member 130, the resin injected into the micropores will not flow into the liquid flow channel 120 (communication channel 121). Of course, the melted resin can be suppressed from flowing into the liquid flow channel 120 based on the same effects even if a different material, such as, for example, a plate-form filter, is used as the elastic member 130. In addition, in the case where an elastomer is used as the elastic member 130, there will essentially be no gaps between the elastic member 130 and the first and second flow channel members 100 and 110, and thus no melted resin will flow into the liquid flow channel 120 due to the elastic member 130.

Incidentally, if the integral molded member 140 is formed in a state where the elastic member 130 is not provided and the first flow channel member 100 and second flow channel member 110 simply make contact with each other, there is a risk that the melted resin will flow into the liquid flow channel 120, resulting in forming foreign objects within the liquid flow channel 120, as well as a risk that the cross-sectional area of the liquid flow channel 120 will be reduced by the resin that has flowed into the channel, resulting in flaws such as the inability to obtain the desired flow rate.

The first flow channel member 100 and the second flow channel member 110 are fixed together integrally (joined through integral molding) as a result of forming the integral molded member 140 in this manner.

Joining the first flow channel member 100 with the second flow channel member 110 using the integral molded member 140 (joining through integral molding) results in the joined regions being covered by the integral molded member 140. This in turn makes it possible to suppress the ink from leaking from between the first flow channel member 100 and the second flow channel member 110. In other words, joining the first flow channel member 100 with the second flow channel member 110 through integral molding using the integral molded member 140 makes it possible to suppress ink leaks to a greater degree than when the flow channel members are joined using an adhesive or are welded together through heat or ultrasonic welding. In particular, when a comparatively long communication channel 121 is provided as the liquid flow channel 120, it is easy for ink to leak from the communication channel 121 if an adhesive or welding is used; however, covering the seam between the first flow channel member 100 and the second flow channel member 110 with the integral molded member 140 makes it possible to suppress ink leaks regardless of the length of the communication channel 121.

In addition, because the integral molded member 140 is formed through molding, a material having a low gas transmissibility, such as a cyclic olefin copolymer (COC), polyphenylene sulfide (PPS), or high-density polyethylene (PE-HD), can be used. Using such a material having a low gas transmissibility as the integral molded member 140 makes it possible to reduce gases of the ink within the liquid flow channel 120 leaking to the exterior and to reduce gas permeation into the liquid flow channel 120 from the exterior. In other words, when an attempt is made to join the first flow channel member with the second flow channel member using an adhesive, adhesives having a low gas transmissibility generally have a low bond strength, and thus there is a risk that bonding failures will occur between the first flow channel member and the second flow channel member, leading to ink leaks and the like in the bonded regions; it is thus difficult to both increase the bonding properties and decrease the gas transmissibility at the same time. However, joining the first flow channel member 100 with the second flow channel member 110 using the integral molded member 140 makes it possible to both increase the bonding properties while decreasing the gas transmissibility with ease.

In addition, because the first flow channel member 100 is joined with the second flow channel member 110 using the integral molded member 140 in this embodiment, a material having high gas barrier properties (a low gas transmissibility) can, like the integral molded member 140, be used as the material for the first flow channel member 100 and the second flow channel member 110. In particular, using the same type of resin for the first flow channel member 100, the second flow channel member 110, and the integral molded member 140 enables the surfaces thereof to melt and bond to one another, creating a firmer joint. This therefore makes it possible to both suppress gases of the ink within the liquid flow channel 120 from leaking to the exterior and to suppress gas from permeating into the liquid flow channel 120 from the exterior. Incidentally, when joining the first flow channel member 100 with the second flow channel member 110 through welding, it is conceivable to use a material that is easily-weldable and resistant to ink leaks for the first flow channel member 100 and the second flow channel member 110; however, this presents a problem in that easily-weldable materials have poor gas barrier properties whereas materials with high gas barrier properties are difficult to weld.

Figure 4A:
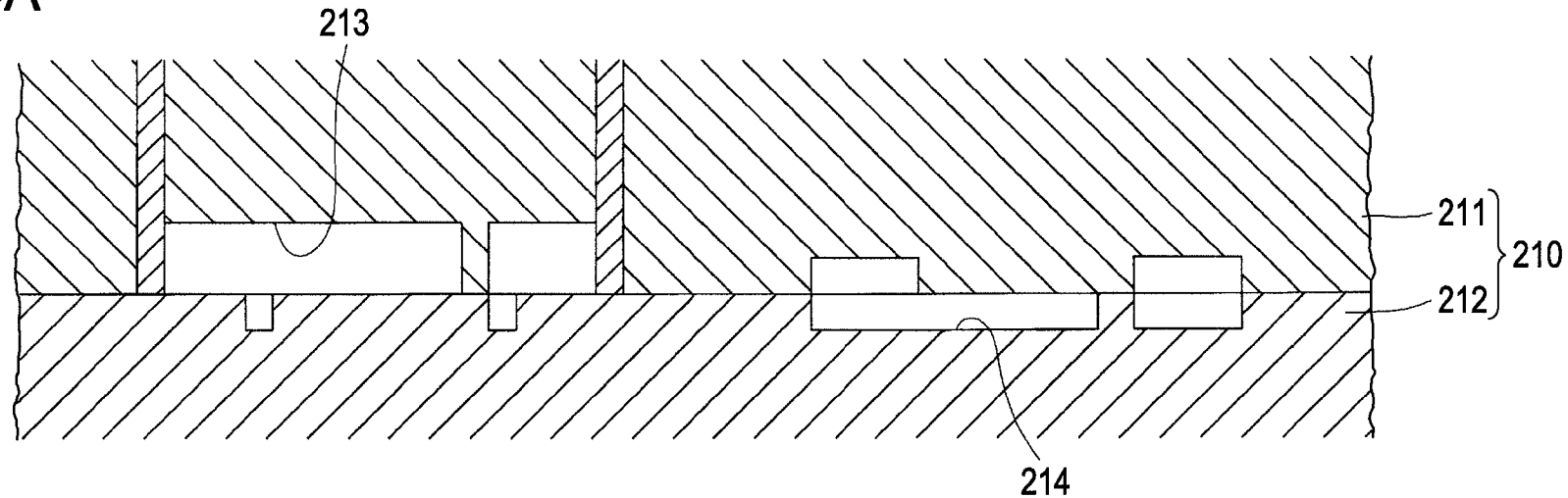
FIGS. 4A and 4B are cross-sections illustrating a manufacturing method for a recording head according to the first embodiment of the invention.
Figure 4B:
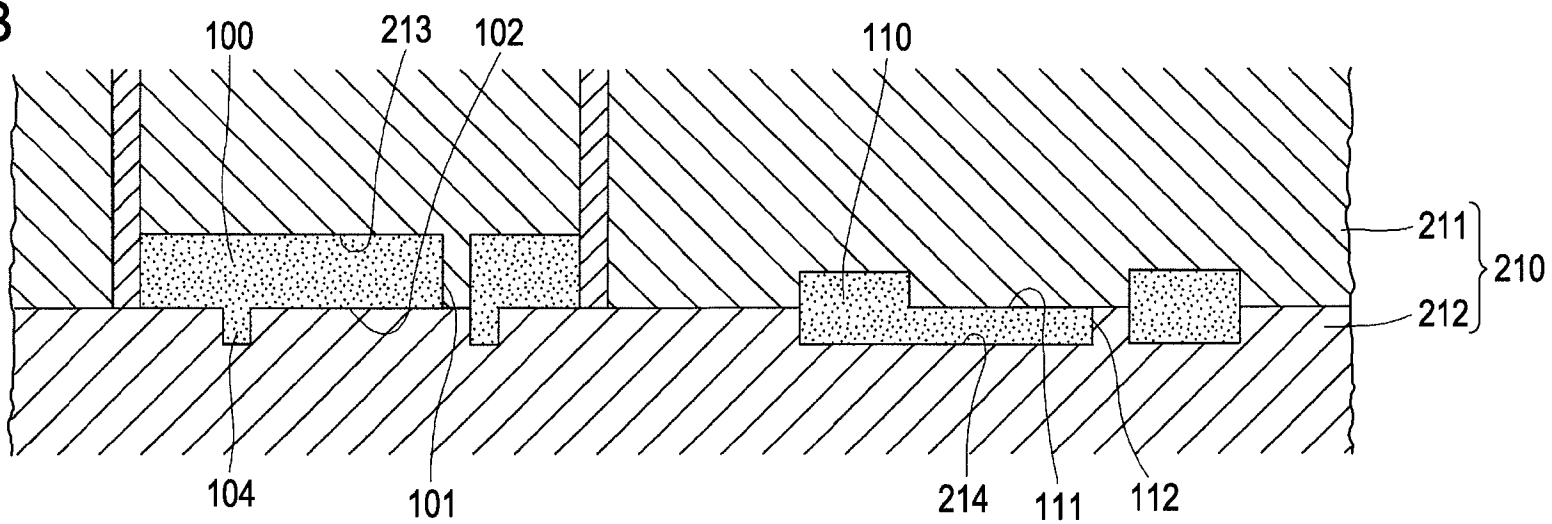

Furthermore, in this embodiment, disposing the elastic member 130 between the first flow channel member 100 and the second flow channel member 110 and then molding the integral molded member 140 makes it possible to join the first flow channel member 100 with the second flow channel member 110, thereby forming the flow channel member 6; therefore, processes for bonding or welding the first flow channel member 100 and the second flow channel member 110 to each other in advance are no longer necessary, thereby making it possible to improve the manufacturing efficiency of the flow channel member 6. In particular, when molding the first flow channel member 100 and the second flow channel member 110 respectively, using a technique such as core-back molding after the first flow channel member 100 and the second flow channel member 110 have been simultaneously molded in a metallic mold makes it possible to mold the integral molded member 140 simply by adding a process for disposing the elastic member 130, without necessitating the removal of the first flow channel member 100 and the second flow channel member 110 from the metallic mold. This type of manufacturing method will now be described with reference to FIGS. 4A, 4B and 5. Note that FIGS. 4A, 4B and 5 are cross-sections illustrating another example of a method for manufacturing an ink jet recording head according to the first embodiment of the invention.

First, the metallic mold 210 will be described. As shown in FIGS. 4A and 4B, the metallic mold 210 is configured of a first metallic mold 211 and a second metallic mold 212, which can separate from each other in the upper and lower directions. The metallic mold 210 is provided with a first cavity 213 that has the same shape as the first flow channel member 100, which is molded therein, and a second cavity 214 that has the same shape as the second flow channel member 110, which is molded therein.

Figure 5:
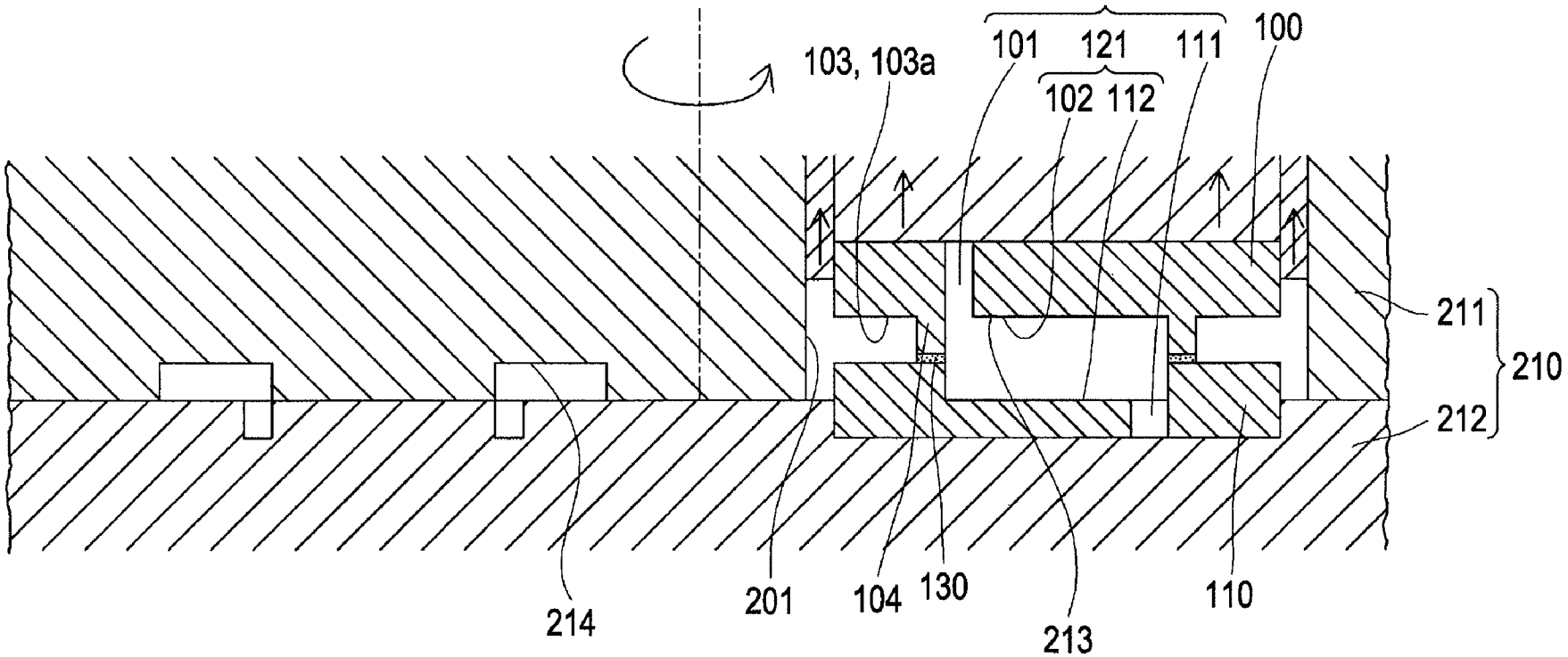
FIG. 5 is a cross-section illustrating a manufacturing method for a recording head according to the first embodiment of the invention.

The first metallic mold 211 is provided rotatably along the surface that makes contact with the second metallic mold 212, so as to switch between the first cavity 213 and the second cavity 214, as shown in FIG. 5.

In addition, the first metallic mold 211 is configured so that the part that defines the first cavity 213 rises in the direction opposite to the second metallic mold 212 (the core retracts).

When forming the flow channel member 6 using such a metallic mold 210, first, as shown in FIG. 4A, the first metallic mold 211 and the second metallic mold 212 are brought into contact with each other, thereby defining the first cavity 213 and the second cavity 214 in the metallic mold 210. Then, as shown in FIG. 4B, a melted resin is injected into the first cavity 213 and the second cavity 214 via a gate (not shown) in the metallic mold 210, thereby molding the first flow channel member 100 and the second flow channel member 110.

Next, as shown in FIG. 5, the first metallic mold 211 is rotated along with the first flow channel member 100. At this time, part of the region of the first metallic mold 211 that forms the first flow channel member 100 rises in the direction opposite the second flow channel member 110 (the core retracts), thereby defining the cavity 201, where the integral molded member 140 will be formed, along the outer circumference of the first flow channel member 100 and the second flow channel member 110. Furthermore, at this time, the aforementioned elastic member 130 is sandwiched between the first flow channel number 100 and the second flow channel member 110.

As described above with reference to FIGS. 3A and 3B, when a melted resin is injected into the cavity 201 via a gate (not shown) in the metallic mold 210 while in such a state, the integral molded member 140 is molded, and the first flow channel member 100 and the second flow channel member 110 are joined together by the integral molded member 140 (joined through integral molding).

Accordingly, forming the first flow channel member 100 and the second flow channel member 110 through molding eliminates the need for removing the molded first flow channel member 100 and the second flow channel member 110 from the metallic mold 210 and carrying out processes such as bonding, and because the first flow channel member 100 and the second flow channel member 110 can be joined through integral molding simply by disposing the elastic member 130 between the first flow channel member 100 and the second flow channel member 110, complex operations can be rendered unnecessary, thereby improving the manufacturing efficiency.

Figure 6:
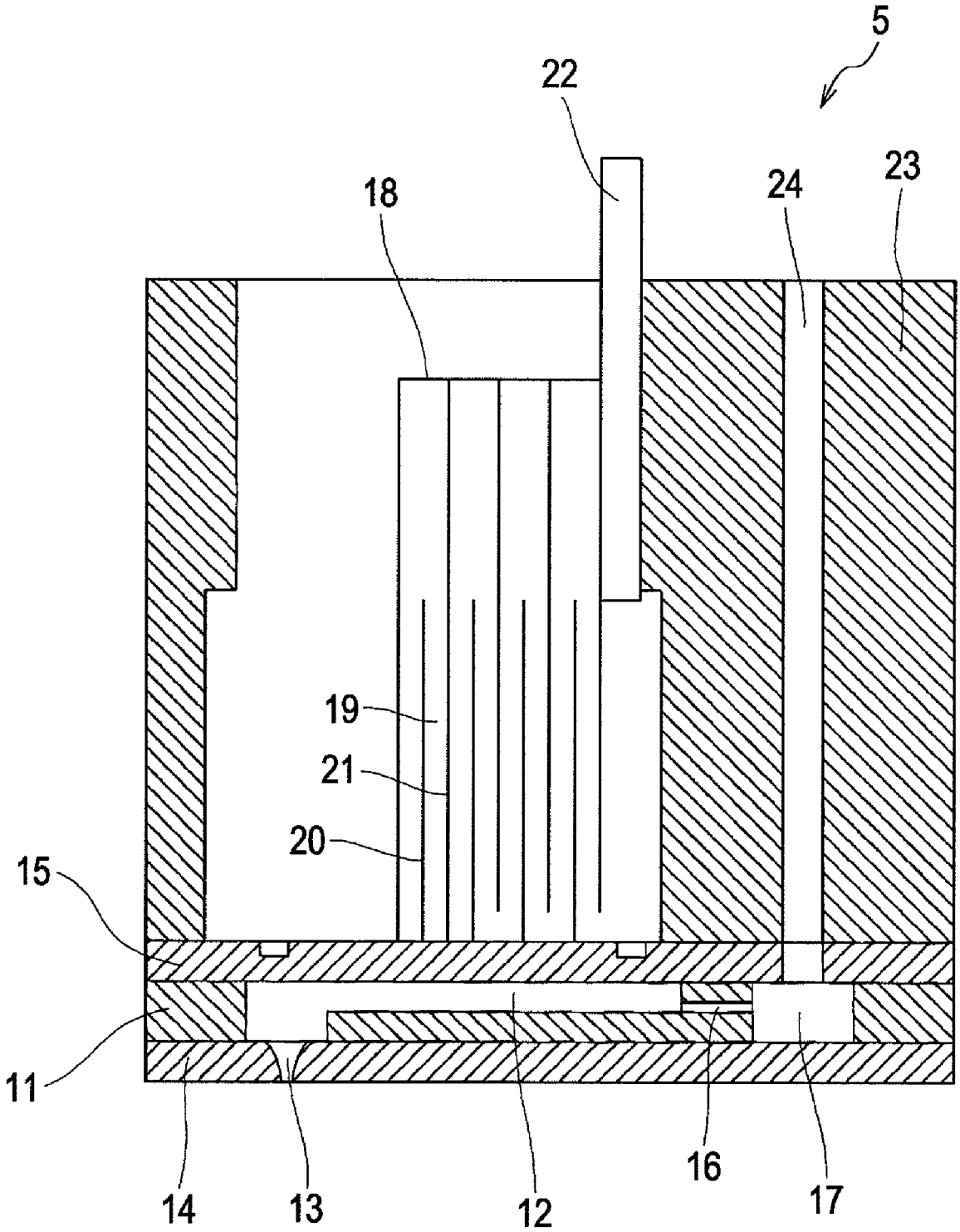
FIG. 6 is a cross-section of the head body according to the first embodiment of the invention.

An example of the head body 5 of the ink jet recording head 3 will now be described. FIG. 6 is a cross-section illustrating an example of head body.

The head body 5 shown in FIG. 6 is a type having a longitudinal vibration piezoelectric element; multiple pressure generating chambers 12 are provided in parallel in a flow channel plate 11, and the sides of the flow channel plate 11 are sealed by a nozzle plate 14 having a nozzle opening 13 corresponding to each pressure generating chamber 12 on one side and a vibrating plate 15 on the other side. In addition, a reservoir 17 is formed in the flow channel plate 11, serving as a common ink chamber for the multiple pressure generating chambers 12 and communicating with each pressure generating chamber 12 via an ink supply opening 16; an ink cartridge (not shown) is connected to the reservoir 17.

Meanwhile, piezoelectric elements 18 are provided on the vibrating plate 15 on the side opposite to the pressure generating chambers 12, with the ends of each piezoelectric element 18 making contact with a region corresponding to a respective pressure generating chamber 12. These piezoelectric elements 18 are configured by layering a piezoelectric material 19 vertically between alternating layers of the electrode-forming materials 20 and 21 in a sandwich-like shape, and an unmoving region that does not contribute to vibrations is anchored to an anchor plate 22.

With the head body 5 configured in this manner, ink is supplied to the reservoir 17 via a flow channel 24 that communicates with the liquid flow channel 120 of the aforementioned flow channel member 6, and is distributed among the pressure generating chambers 12 via the ink supply openings 16. The piezoelectric elements 18 are caused to retract by applying a voltage to the piezoelectric elements 18. As a result, the vibrating plate 15 deforms along with the piezoelectric elements 18 (in FIG. 6, retracts in the upward direction), causing the capacity of the pressure generating chambers 12 to increase, thereby pulling ink into the pressure generating chambers 12. After ink has filled the chambers up to the nozzle openings 13, the voltage applied to the electrode-forming materials 20 and 21 of the piezoelectric elements 18 is removed based on a recording signal from a driving circuit, causing the piezoelectric elements 18 to extend and return to their original states. Through this, the vibrating plate 15 is also displaced and returns to its original state, thereby causing the pressure generating chambers 12 to shrink, increasing the internal pressure thereof and discharging ink droplets from the nozzle openings 13 as a result. In other words, in this embodiment, longitudinal vibration piezoelectric elements 18 are provided as pressure generating units causing a change in the pressure of the pressure generating chambers 12.

Other Embodiments

Although the invention has been described thus far using an exemplary embodiment, the invention is not intended to be limited to the basic configuration described above. For example, although the integral molded member 140 is provided only in the side surface of the flow channel member 6 in the aforementioned first embodiment, extending the integral molded member 140 to the pair of surfaces in which the liquid flow channel 120 of the flow channel member 6 opens to makes it possible to further improve the strength of the joint obtained by joining the first flow channel member 100 with the second flow channel member 110 through integral molding.

Furthermore, although the above first embodiment discusses an example of the ink jet recording head 3 configured of the flow channel member 6 and the head body 5, a member equivalent to the aforementioned flow channel member 6 may be provided, for example, partway along the supply line 4, between the reservoir unit 1 and the supply line 4, and so on. In other words, if the entire configuration from the reservoir unit 1 to the head body 5 is defined as an ink jet recording head, the flow channel member 6 may be provided in any of the elements from the reservoir unit 1 to the head body 5. Of course, the flow channel member 6 may be provided in part of the head body 5.

In addition, although the above first embodiment describes an example of the flow channel member 6 in which the liquid flow channel 120 is provided, the flow channel member 6 may be provided with, for example, a filter, a valve mechanism, a heating unit, or the like. Furthermore, although the above first embodiment describes an example of an ink jet recording apparatus I in which only the ink jet recording head 3 is mounted in the carriage 2 and the reservoir unit 1 is not mounted in the carriage 2, the invention is not particularly limited thereto, and the reservoir unit 1 may, for example, be mounted in the carriage 2 along with the ink jet recording head 3. In such a case, a dispensing needle or the like that is inserted into the reservoir unit 1 may be provided in the flow channel member.

In addition, the number, disposition, and so on of liquid flow channels 120 provided in the flow channel member 6 are not limited to the descriptions provided above; for example, two or more independent liquid flow channels 120 may be provided, or the liquid flow channel may have a single input channel 101 and an output channel 111 that branches into multiple channels. Furthermore, although the communication channel 121, extending along the surface direction of the joint surfaces between the first flow channel member 100 and the second flow channel member 110, is provided as the liquid flow channel 120 in the aforementioned first embodiment, the invention is not limited thereto, and, for example, an input unit 101 extending in the vertical direction relative to the joint surface communicating with an output unit 111 extending in the vertical direction relative to the joint surface may be provided as the liquid flow channel 120.

In addition, although the above descriptions of the ink jet recording apparatus I illustrate an example in which the ink jet recording head 3 is mounted in the carriage 2 and moves along the main scanning direction, the invention is not particularly limited thereto; for example, the invention can also be applied in a so-called line-type recording apparatus, in which the ink jet recording head 3 is anchored and printing is performed simply by moving the recording sheet S, which is paper or the like, in the sub scanning direction.

Furthermore, although the aforementioned first embodiment describes the use of an actuator device, using longitudinal vibration piezoelectric elements, as a pressure generating unit causing a change in the pressure of the pressure generating chambers 12, the invention is not particularly limited thereto; for example, an actuator device having a piezoelectric thin film in which a lower electrode, piezoelectric layer, and upper electrode are formed as layers through deposition and lithography, a thick-film actuator device formed through methods such as green sheet lamination, or the like may be used. Moreover, a device in which heating elements are disposed within the pressure generating chambers 12 and liquid is discharged from the nozzle openings due to bubbles forming as a result of the heat from the heating elements, a so-called electrostatic actuator that generates static electricity between a vibration plate and an electrode, with the resulting static electricity force causing the vibration plate to distort and liquid to be discharged from the nozzle openings, can also be used.

Furthermore, the invention is widely aimed at liquid ejecting heads in general, and therefore can also be applied in, for example, recording heads such as various types of ink jet recording heads used in image recording apparatuses such as printers or the like; coloring material ejecting heads used in the manufacture of color filters for liquid crystal displays and the like; electrode material ejecting heads used for forming electrodes in organic EL displays, FEDs (field emission displays), and so on; bioorganic compound ejection heads used in the manufacture of biochips; and so on. Moreover, although the ink jet recording apparatus I has been described as an example of a liquid ejecting apparatus, it is also possible to use a liquid ejecting apparatus that utilizes one of the other liquid ejecting heads mentioned above.

What is claimed is:

1. A liquid ejecting head comprising:

a first flow channel member that configures part of the wall surface of a liquid flow channel;

a second flow channel member that configures a different part of the wall surface of the liquid flow channel than the part configured by the first flow channel member; and an integral molded member, formed around the liquid flow channel, that joins the first flow channel member with the second flow channel member through integral molding, wherein an elastic member that is sandwiched between the first flow channel member and the second flow channel member and is more elastically deformable than the first flow channel member and the second flow channel member, is provided around the liquid flow channel, wherein the elastic member does not protrude into the liquid flow channel; and the integral molded member is formed on the outside of the elastic member sandwiched between the first flow channel member and the second flow channel member.

2. The liquid ejecting head according to claim 1, wherein the elastic member is formed by weaving filaments together.

3. The liquid ejecting head according to claim 1, wherein the elastic member is a plate-shaped member in which multiple pores are formed.

4. The liquid ejecting head according to claim 3, wherein a non-planarity is formed in at least one side of the plate-shaped member.

5. A liquid ejecting apparatus comprising the liquid ejecting head according to claim 1.

6. A manufacturing method for a liquid ejecting head, wherein the liquid ejecting head includes:

a first flow channel member that configures part of the wall surface of a liquid flow channel;

a second flow channel member that configures a different part of the wall surface of the liquid flow channel than the part configured by the first flow channel member; and an integral molded member, formed around the liquid flow channel, that joins the first flow channel member with the second flow channel member through integral molding, and the method comprises, in a state in which an elastic member that is more elastically deformable than the first flow channel member and the second flow channel member is sandwiched between the first flow channel member and the second flow channel member around the liquid flow channel, and not protruding into the liquid flow channel:

forming, through integral molding, an integral molded member on the outside of the elastic member sandwiched between the first flow channel member and the second flow channel member, thereby joining the first flow channel member with the second flow channel member.

7. The manufacturing method according to claim 6, further comprising forming the elastic member by weaving filaments together.

8. the manufacturing method according to claim 6, wherein the elastic member is a plate-shaped member in which multiple pores are formed.

9. the manufacturing method according to claim 8, wherein a non-planarity is formed in at least one side of the plate-shaped member.

10. The manufacturing method of claim 6, further comprising installing the liquid ejecting head into a liquid ejecting apparatus.

* * * * *